US010816936B2

(12) United States Patent
Hurni

(10) Patent No.: US 10,816,936 B2
(45) Date of Patent: Oct. 27, 2020

(54) REMOTE CONTROL MECHANISM FOR TIMEPIECES

(71) Applicant: Montres Jaquet Droz SA, La Chaux-de-Fonds (CH)

(72) Inventor: David Hurni, La Chaux-de-Fonds (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 152 days.

(21) Appl. No.: 15/964,786

(22) Filed: Apr. 27, 2018

(65) Prior Publication Data

US 2018/0314211 A1 Nov. 1, 2018

(30) Foreign Application Priority Data

Apr. 28, 2017 (EP) ..... 17168585

(51) Int. Cl.

| | |
|---|---|
| ***G04B 27/06*** | (2006.01) |
| ***G04C 13/00*** | (2006.01) |
| ***G04B 3/04*** | (2006.01) |
| ***G04B 37/06*** | (2006.01) |

(52) U.S. Cl.

CPC ..... *G04C 13/00* (2013.01); *G04B 3/048* (2013.01); *G04B 27/06* (2013.01); *G04B 37/064* (2013.01); *G04B 37/066* (2013.01)

(58) Field of Classification Search

CPC ..... G04C 13/00; G04B 27/06; G04B 3/048; G04B 37/066; G04B 37/064; G04B 37/06; G04B 27/065; G04B 27/04

See application file for complete search history.

(56) References Cited

U.S. PATENT DOCUMENTS 966,149 A * 8/1910 Wolf
1,327,391 A * 1/1920 Jordan ..... G04B 27/023 368/199
4,364,674 A 12/1982 Tesch
4,555,185 A * 11/1985 Vuilleumier ..... G04B 27/00 368/184

(Continued)

FOREIGN PATENT DOCUMENTS

CH 709 909 A1 1/2016
EP 1 553 468 A1 7/2005

(Continued)

OTHER PUBLICATIONS

European Search Report dated Oct. 20, 2017 in European Application 17168585.2, filed on Apr. 28, 2017 (with English Translation of Categories Cited).

*Primary Examiner* — Sean Kayes
(74) *Attorney, Agent, or Firm* — Oblon, McClelland, Maier & Neustadt, L.L.P.

(57) ABSTRACT

Watch comprising a movement with an axially and rotationally movable main stem, and a control mechanism for the remote control of the main stem which comprises a secondary stem operable by a user and guided in rotation by guide means of a plate, and axial stop means for a secondary pinion integral in rotation with the secondary stem, and a transmission train meshed with the secondary pinion to transmit any rotation of the secondary pinion to the main stem, and further comprises an articulated connection, arranged to transmit any axial motion of the secondary stem to the main stem.

11 Claims, 4 Drawing Sheets

(56) References Cited

U.S. PATENT DOCUMENTS

| | | | | |
|---|---|---|---|---|
| 5,042,016 | A * | 8/1991 | Suzuki | G04C 3/007 368/74 |
| 5,214,625 | A * | 5/1993 | Suzuki | G04C 3/007 368/185 |
| 7,563,020 | B2 * | 7/2009 | Pittet | G04B 3/046 368/190 |
| 8,235,584 | B2 * | 8/2012 | Wyssbrod | G04F 7/0842 368/101 |
| 8,439,558 | B2 * | 5/2013 | Pittet | G04B 37/066 368/192 |
| 2007/0025191 | A1 * | 2/2007 | Pittet | G04B 3/046 368/319 |
| 2007/0153640 | A1 | 7/2007 | Saunier | |
| 2011/0216631 | A1 * | 9/2011 | Pittet | G04B 27/04 368/190 |

FOREIGN PATENT DOCUMENTS

| | | |
|---|---|---|
| FR | 2 435 077 | 3/1980 |
| WO | WO 2006/106088 A1 | 10/2006 |

* cited by examiner

REMOTE CONTROL MECHANISM FOR TIMEPIECES

This application claims priority from European patent application No. 17168585.2 filed on Apr. 28, 2017, the entire disclosure of which is hereby incorporated herein by reference.

FIELD OF THE INVENTION

The invention concerns a timepiece control mechanism for the remote control of an axially and rotationally movable main operating stem of a timepiece movement, said control mechanism comprising a secondary stem arranged to be operated by a user to control the motion of said main stem, and wherein said control mechanism comprises a plate arranged to be secured to a said movement or to form a structural element of a said movement, which plate comprises means for guiding rotation of said secondary stem, and axial stop means for a secondary pinion with respect to which said secondary stem is free in translation and integral in rotation, wherein said control mechanism comprises a transmission train meshed with said secondary pinion and arranged to transmit any rotation of said secondary pinion to said main stem, and further comprises an articulated connection arranged to transmit any axial motion of said secondary stem to said main stem.

The invention further concerns a watch comprising at least one timepiece movement comprising an axially and rotationally movable main operating stem, and such a control mechanism.

The invention concerns the field of timepiece control mechanisms.

BACKGROUND OF THE INVENTION

The design of timepiece movements, and more particularly of mechanical timepiece movements, rarely allows for versatility in the use of such movements. In particular, a given movement is generally devised either for a wristwatch, or for a pocket watch. It is then difficult to adapt a movement to a different form of watch for which it was not designed. Likewise, it is inconvenient to modify the angular orientation of the axes of the control mechanisms, for example to create airplane pilot watches.

It is even more difficult to overcome the space constraints associated with the housing of complications, whose controls cannot be far away from the members which they operate. In particular, controls for actuating or setting chronographs, for changing time zones, for an alarm or striking work, are generally disposed in immediate proximity to the supports of these functions. It is often not possible to use a control extension piece, such as a bolt or similar, without substantially increasing the diameter, or more generally, the dimensions of the watch case. Likewise, the use of parallel control arbors connected by a gear train, which is sometimes required by geometric constraints, does not allow for a significant shift in position, and always entails an increase in the dimensions of the movement.

SUMMARY OF THE INVENTION

The invention proposes to implement a remote control mechanism for timepieces, capable of being housed anywhere, and in any orientation, in a watch case, for controlling a timepiece movement that is also housed inside said case, but not necessarily designed to be controlled from any position of the case.

To this end, the invention concerns a timepiece control mechanism for the remote control of an axially and rotationally movable main operating stem of the timepiece movement. The invention further concerns a watch comprising at least one timepiece movement comprising an axially and rotationally movable main operating stem, and such a control mechanism.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
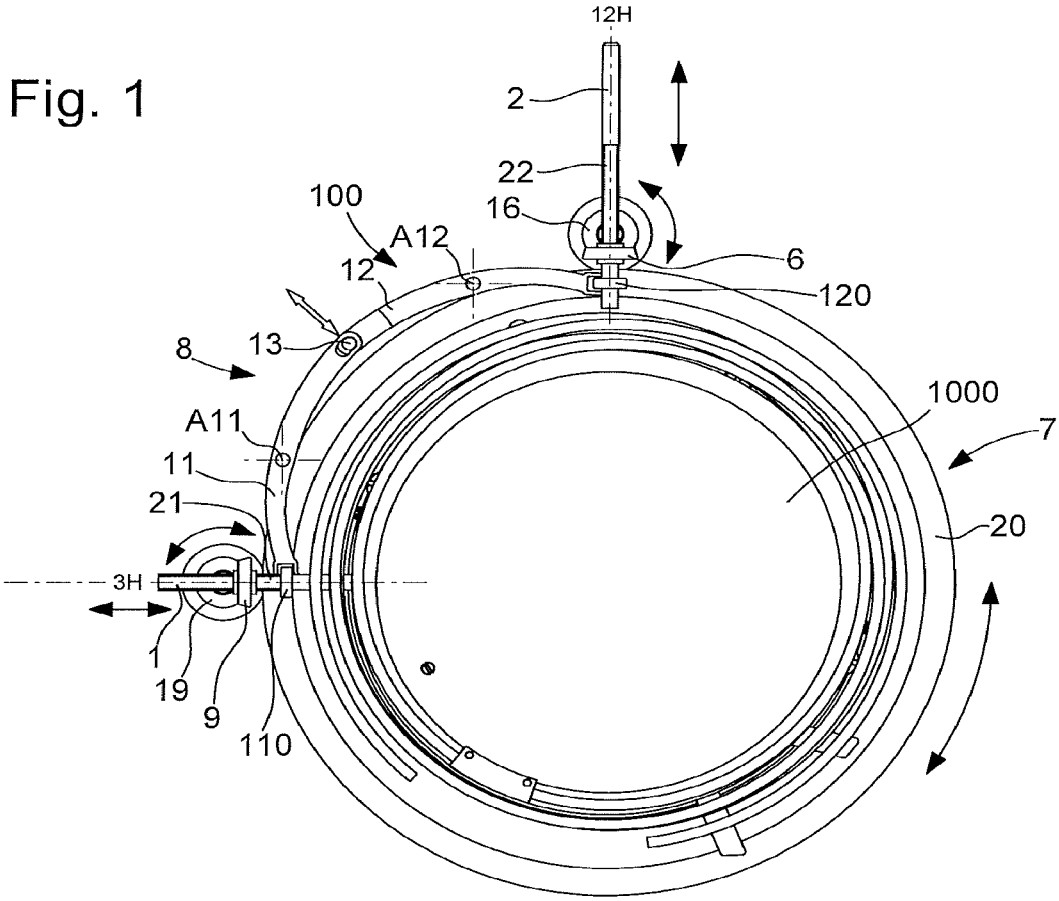
FIG. 1 represents a schematic back view of a timepiece movement equipped with a remote control mechanism according to the invention, arranged for operating a main stem positioned at 3 o'clock, visible on the left of the Figure, via a secondary stem positioned at 12 o'clock, seen at the top of the Figure.
Figure 2:
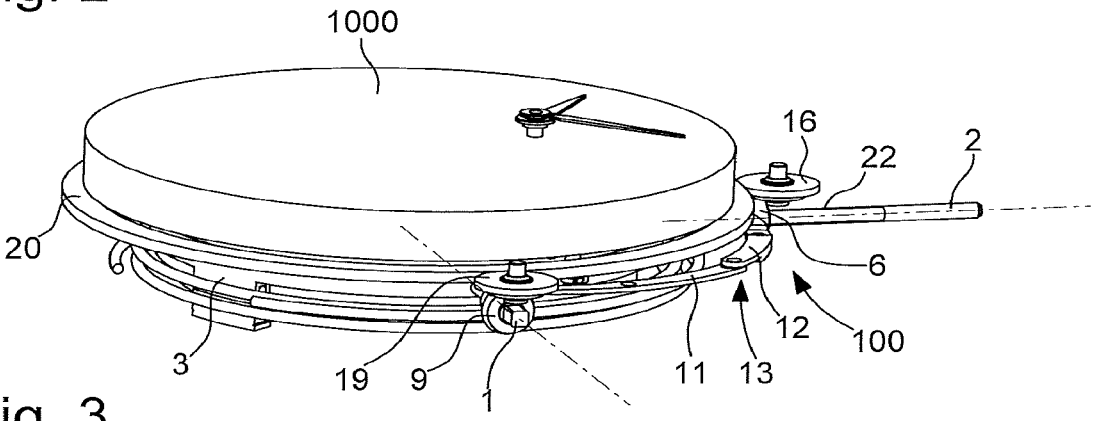
FIG. 2 represents a schematic and perspective top view of the movement of FIG. 1.
Figure 3:
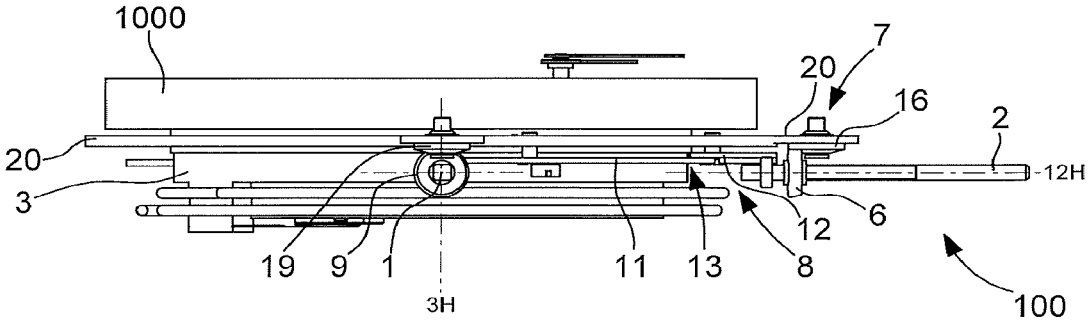
FIG. 3 represents a schematic side view, from the 3 o'clock position, of the movement of FIG. 1, wherein the 12 o'clock position is seen on the right of the Figure.
Figure 4:
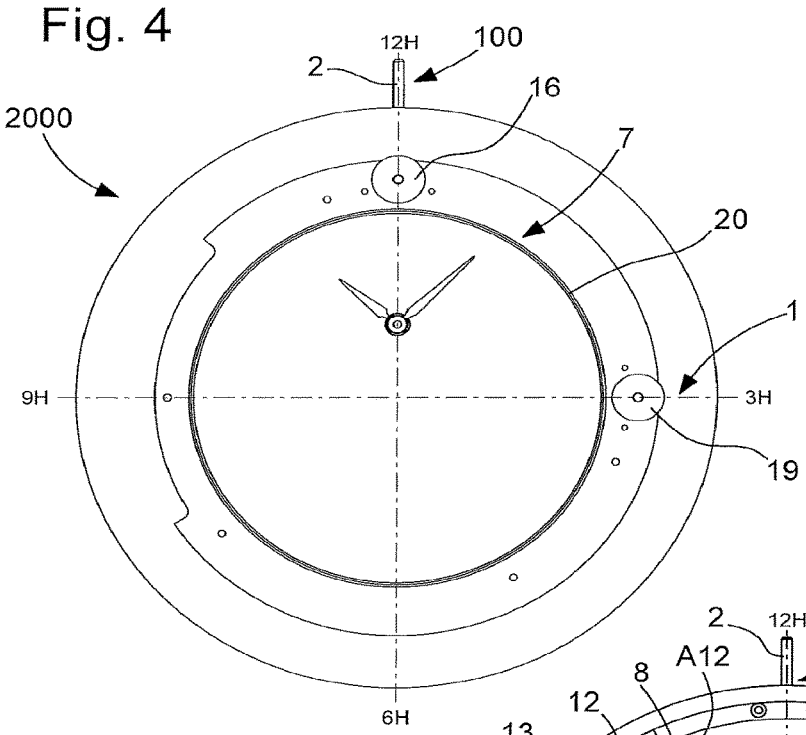
FIG. 4 represents a schematic, front view, which is partially transparent as regards the control mechanism of the invention, of a watch containing the timepiece movement of FIG. 1.
Figure 5:
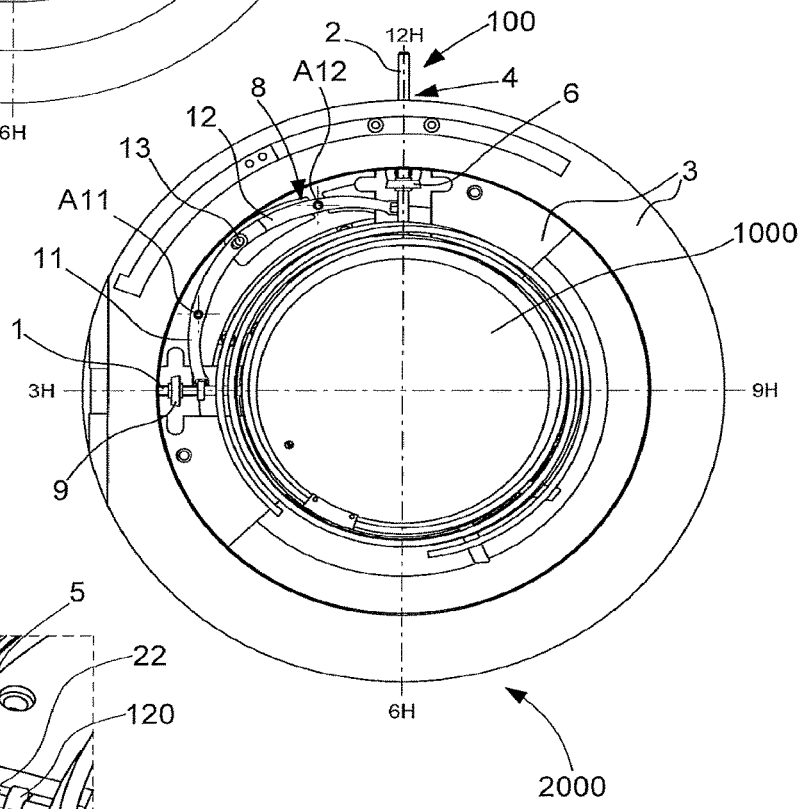
FIG. 5 represents a schematic, back view, which is partially transparent as regards the control mechanism of the invention, of the watch of FIG. 4.

The invention concerns a timepiece control mechanism 100, for the remote control of a main operating stem 1 of a timepiece movement 1000, this main stem 1 being movable axially and in rotation.

According to the invention, this control mechanism 100 comprises a secondary stem 2, which is arranged to be operated by a user to control the motion of main stem 1.

The invention is illustrated by a particular, non-limiting embodiment, wherein the invention allows the winding crown of a watch to be shifted from the 3 o'clock position that is usual for wristwatches, to the 12 o'clock position that is usual for pocket watches, by using a standard wristwatch movement comprising a winding stem at 3 o'clock. It is by means of two levers and a set of trains and intermediate wheels, all placed inside the watch case, that it is possible to actuate the winding stem of the movement, located in the 3 o'clock position, by means of the crown, which is located at the 12 o'clock position in the case. Naturally, the invention can be implemented for any type of control: chronograph, time zone, striking work, or other, and in any angular position.

In the illustrated example, the levers can actuate the pull-out piece, in order to actuate, via the crown, either the winding mechanism of the movement, or the setting mechanism.

The gear and intermediate wheel system thus allows the movement stem at 3 o'clock to be rotated by rotating the crown at 12 o'clock.

Figure 6:
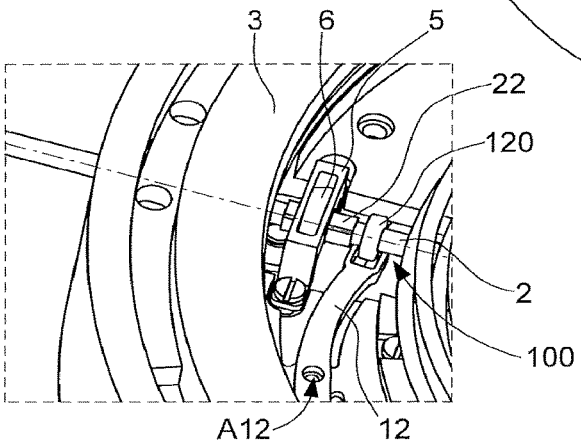
FIG. 6 represents a schematic, perspective view of a detail of the control mechanism as it is seen in the watch in FIG. 5.

To this end, control mechanism 100 comprises a plate 3, which is arranged to be secured to a movement 1000, or to form a structural element of a movement 1000, such as a plate, bridge or suchlike. This plate 3 comprises means 4 for guiding rotation of secondary stem 2. Plate 3 also comprises axial stop means 5 for a secondary pinion 6, with respect to which secondary stem 2 is free in translation and integral in rotation. FIG. 6 represents these axial stop means 5 in the form of a small bridge forming a yoke and which prevents axial translation of secondary pinion 6, which is driven in rotation by a square 22, or suchlike, of secondary stem 2.

Control mechanism 100 comprises a transmission train 7, which is meshed with secondary pinion 6, and which is arranged to transmit any rotation of secondary pinion 6 to main stem 1. Control mechanism 100 further comprises an articulated connection 8, which is arranged to transmit any axial motion of secondary stem 2 to main stem 1.

More particularly, articulated connection 8 comprises at least, at a first end, a first lever 11 which is pivoted on plate 3, on a first axis A11. Articulated connection 8 comprises at least, at a second end, a second lever 12 also pivoted on plate 3, on a second axis A12. First lever 11 is articulated at the first end with main stem 1, for example, but in a non-limiting manner, as illustrated, with a first fork gripping a first runner 110, and second lever 12 is articulated at the second end with secondary stem 2, for example with a second fork gripping a second roller 120.

This first lever 11 is articulated to second lever 12, by an intermediate articulation 13, or by other levers articulated to each other.

In particular, first lever 11 forms a first pull-out piece with main stem 1, and second lever 12 forms a second pull-out piece with secondary stem 2.

In a particular embodiment, as illustrated by the Figures, articulated connection 8 is limited to first lever 11 articulated to second lever 12 by intermediate articulation 13.

In particular, control mechanism 100 comprises a main pinion 9, which is arranged to be mounted freely in translation on main stem 1, and integral in rotation therewith, and transmission train 7 is meshed with this main pinion 9.

Depending on kinematics, transmission train 7 comprises a first intermediate wheel 19 arranged to cooperate with main pinion 9, and/or a second intermediate wheel 16 arranged to cooperate with secondary pinion 6. More particularly, when transmission train 7 comprises such a first intermediate wheel 19 and such a second intermediate wheel 16, transmission train 7 comprises, at least one third intermediate wheel 20 interposed between first intermediate wheel 19 and second intermediate wheel 16, in a particular embodiment illustrated by the Figures. More particularly, transmission train 7 only comprises, one third intermediate wheel 20 interposed between first intermediate wheel 19 and second intermediate wheel 16.

In particular, interposed third intermediate wheel 20 is an annular wheel arranged to surround movement 1000. The plane of this ring is parallel here to the axes of main stem 1 and of secondary stem 2, in the particular case of the illustrated embodiment. More particularly, the axes of main stem 1 and of secondary stem 2 are coplanar, as in the case of the Figures, but the design of the invention also allows for other geometries.

Figure 7:
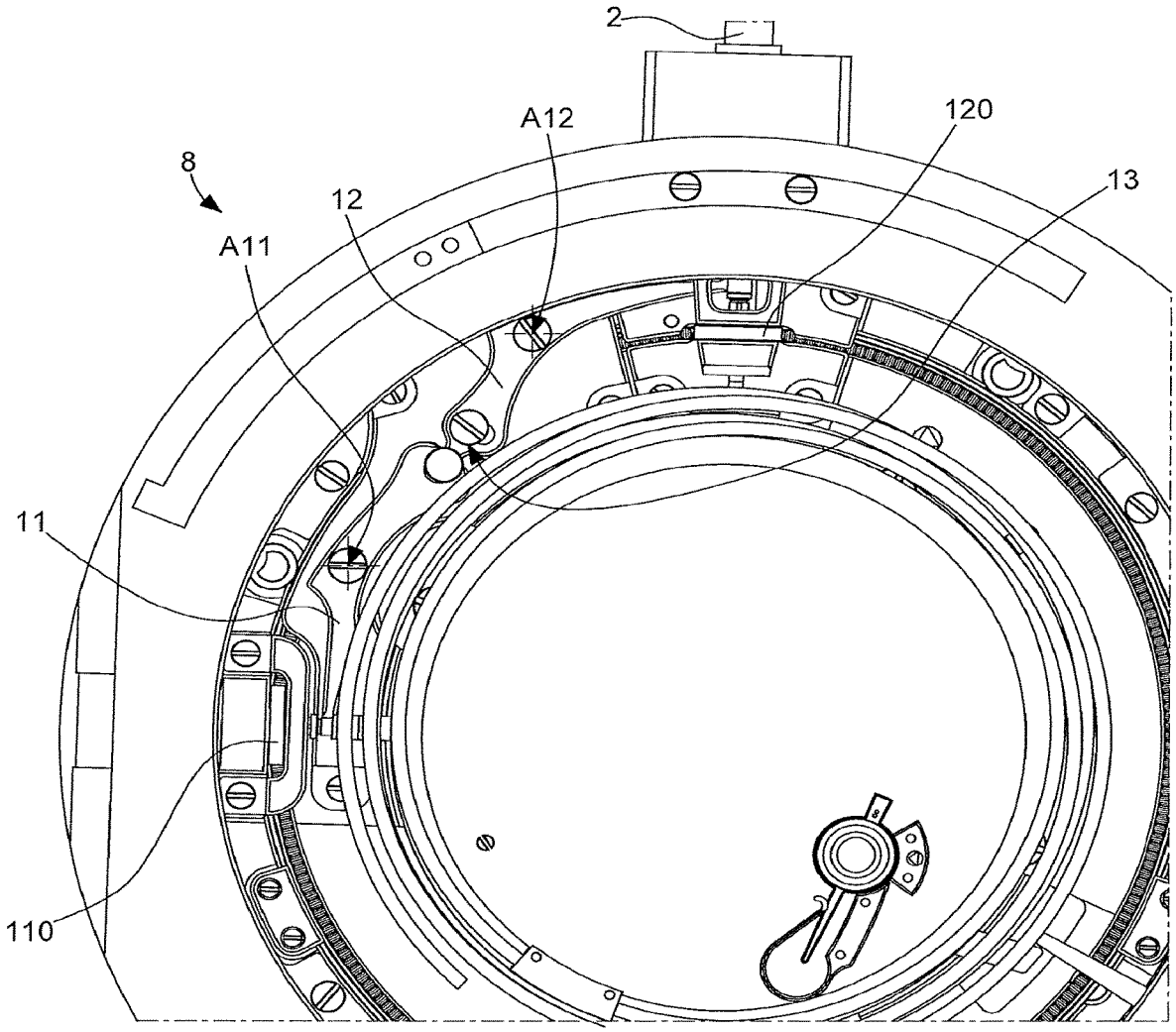
FIGS. 7 to 9 represent—in a back view similar to FIG. 1 in FIG. 7, and similar details to FIG. 6 illustrated in FIGS. 8 and 9—a variant of the mechanism of FIGS. 1 to 6, devoid of intermediate wheel sets with conical teeth, and wherein gearing occurs directly on a ring with teeth cut at 90°.
Figure 8:
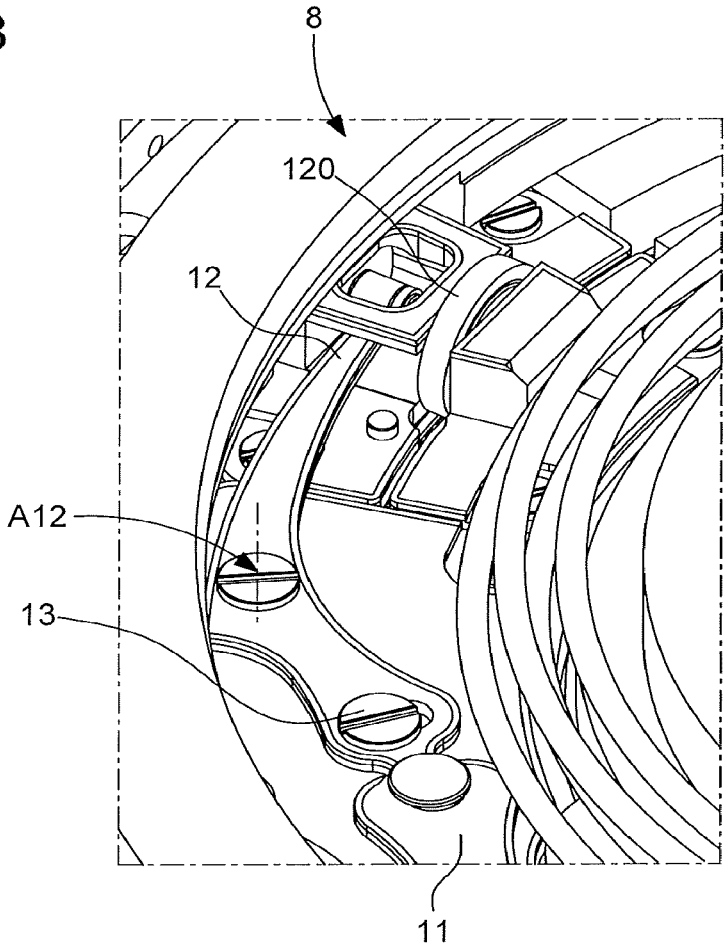
Figure 9:
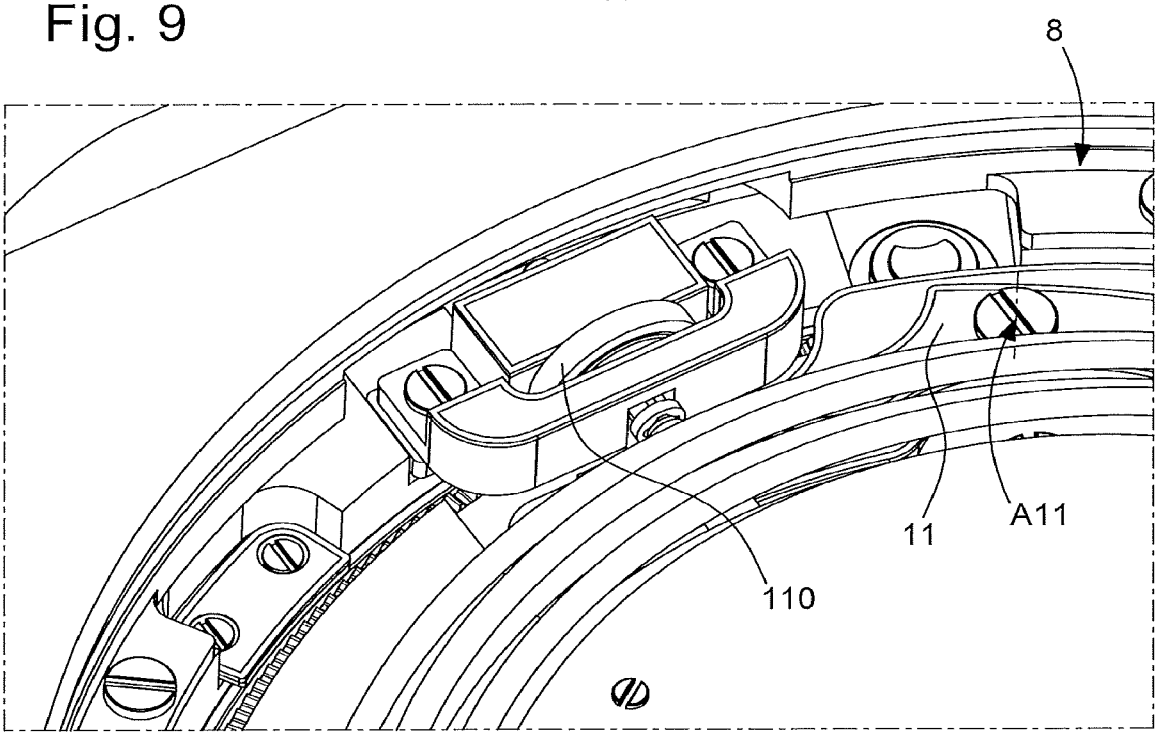

FIGS. 7 to 9 illustrate a variant, devoid of intermediate wheel sets with conical teeth, and wherein gearing occurs directly on a ring with teeth cut at 90°.

In particular, plate 3 is a case middle which is arranged to contain movement 1000.

The invention further concerns a watch 2000 comprising at least one timepiece movement 1000 comprising an axially and rotationally movable main operating stem 1, and such a control mechanism 100.

More particularly, this watch 2000 is a pocket watch, and movement 1000 is a wristwatch movement.

In a particular application, main stem 1 is a setting and/or winding stem.

The invention therefore makes it possible to shift control mechanisms to different positions in the watch case, which means, in particular, that the same movement can be used for a wristwatch or a pocket watch with only a few modifications, or control mechanisms can be housed inside the watch case in places that are not occupied by complications, to optimise the space available inside the case.

The invention also makes it possible to create ergonomic controls whose position is no longer dictated simply by the location of the function to be controlled, and in particular, to make watches for left-handed users who represent, depending on the country, around 5% to 15% of the population.

In particular, the illustrated mechanism is assembled in the following assembly order:

- pre-assembly of runners and posts in the casing ring;
- assembly of the movement (with an additional plate without gongs or stem) on the casing ring, paying particular attention to the angular position of the minute repeater control;
- fitting of the toothed ring;
- assembly of the three small bars holding the ring;
- assembly of the support bar for the pull-out piece levers;
- insertion of the stem into the movement;
- assembly of the second pull-out piece lever, connected to the movement stem;
- sliding translation of the winding pinion on the square of the movement stem;
- lateral assembly of the bar holding the winding pinion while guiding the stem onto the casing ring;
- vertical assembly of the fork-shaped bar holding the winding pinion, on the preceding bar;
- assembly of the bar holding the case middle stem onto the casing ring;
- mounting of the entire assembly thereby formed onto the case middle;
- placing of the second winding pinion inside the housing of the bar holding the case middle stem;
- sliding translation, from the exterior, of the case middle stem (which may be pre-assembled with the crown), paying particular attention to the insertion of the winding pinion into the square. Thus, the gaskets are not scratched by the thread of the stem;
- assembly of the first pull-out piece lever connected to the case middle stem, and retention of the movement stem;
- assembly of the gongs;
- assembly of the back cover and crystal.

What is claimed is:

1. A timepiece control mechanism for the remote control of an axially and rotationally movable main stem for operating a timepiece movement, said control mechanism comprising:

a secondary stem arranged to be operated by a user to control the motion of said main stem; and said control mechanism comprising a plate arranged to be secured to a said movement or to form a structural element of a said movement; said plate including:

a rotation guide that guides rotation of said secondary stem, and an axial stop that stops axial rotation of a secondary pinion, said secondary stem being free in translation and integral in rotation with said secondary pinion;

said control mechanism further comprising:

a transmission train meshed with said secondary pinion and arranged to transmit any rotation of said secondary pinion to said main stem; and an articulated connection arranged to transmit any axial motion of said secondary stem to said main stem, wherein said articulated connection includes, at a first end, a first lever pivoted about a first axis and, at a second end, a second lever pivoted about a second axis, said first lever being articulated to said second lever by an intermediate articulation, said first axis being spaced from said second axis, said first lever being articulated at said first end with said main stem, said second lever being articulated at said second end with said secondary stem.

2. A timepiece control mechanism for the remote control of an axially and rotationally movable main stem for operating a timepiece movement, said control mechanism comprising:

a secondary stem arranged to be operated by a user to control the motion of said main stem; and said control mechanism comprising a plate arranged to be secured to a said movement or to form a structural element of a said movement; said plate including:

a rotation guide that guides rotation of said secondary stem, and an axial stop that stops axial rotation of a secondary pinion, said secondary stem being free in translation and integral in rotation with said secondary pinion;

said control mechanism further comprising:

a transmission train meshed with said secondary pinion and arranged to transmit any rotation of said secondary pinion to said main stem; and an articulated connection arranged to transmit any axial motion of said secondary stem to said main stem, wherein said articulated connection includes, at a first end, a first lever pivoted on said plate and, at a second end, a second lever pivoted on said plate, said first lever being articulated to said second lever by an intermediate articulation, said first lever being articulated at said first end with said main stem, said second lever being articulated at said second end with said secondary stem, and wherein said first lever forms a first pull-out piece with said main stem, and said second lever forms a second pull-out piece with said secondary stem.

3. The control mechanism according to claim 1, wherein said articulated connection includes only said first lever, said second lever, and said intermediate articulation, and said intermediate articulation directly connects said first level to said second lever.

4. The control mechanism according to claim 1, wherein said control mechanism comprises a main pinion arranged to be mounted freely in translation on said main stem and integral in rotation therewith, and wherein said transmission train is meshed with said main pinion.

5. The control mechanism according to claim 4, wherein said transmission train comprises, at least one third intermediate wheel interposed between a first intermediate wheel arranged to cooperate with said main pinion and a second intermediate wheel arranged to cooperate with said secondary pinion.

6. The control mechanism according to claim 5, wherein said at least one third intermediate wheel includes only one third intermediate wheel interposed between said first intermediate wheel and said second intermediate wheel.

7. The control mechanism according to claim 5, wherein said one third intermediate wheel is an annular wheel arranged to be fitted around said movement.

8. The control mechanism according to claim 1, wherein said plate is a case middle arranged to contain said movement.

9. A watch comprising at least one timepiece movement comprising an axially and rotationally movable main operating stem, and a control mechanism according to claim 1.

10. The watch according to claim 9, wherein said main stem is a setting and/or winding stem.

11. A timepiece control mechanism for the remote control of an axially and rotationally movable main operating stem of a timepiece movement, said control mechanism comprising a secondary stem arranged to be operated by a user to control the motion of said main stem; a plate arranged to be secured to a said movement or to form a structural element of a said movement; said plate including a rotation guide that guides rotation of said secondary stem, and an axial stop that stops axial movement of a secondary pinion, said secondary stem being free in translation and integral in rotation with said secondary pinion, said control mechanism further comprising a transmission train meshed with said secondary pinion and arranged to transmit any rotation of said secondary pinion to said main stem; an articulated connection arranged to transmit any axial motion of said secondary stem to said main stem; and a main pinion mounted freely in translation on said main stem and integral in rotation with said main pinion, said transmission train being meshed with said main pinion, wherein said transmission train includes at least one third intermediate wheel interposed between a first intermediate wheel arranged to cooperate with said main pinion and a second intermediate wheel arranged to cooperate with said secondary pinion, and wherein said at least one third intermediate wheel is an annular wheel arranged to be fitted around said movement.

* * * * *